US006086328A

United States Patent [19]

Lee

[11] Patent Number: 6,086,328

[45] Date of Patent: Jul. 11, 2000

[54] TAPERED TIP TURBINE BLADE

[75] Inventor: Ching-Pang Lee, Cincinnati, Ohio

[73] Assignee: General Electric Company, Cincinnati, Ohio

[21] Appl. No.: 09/217,105

[22] Filed: Dec. 21, 1998

[51] Int. Cl.[7] ..... F01D 11/08; F01D 5/28

[52] U.S. Cl. ..... 416/97 R; 416/92; 416/95; 416/97 A; 416/231 B; 416/232; 416/235; 416/237; 415/115

[58] Field of Search ..... 416/92, 95, 96 R, 416/97 A, 97 R, 231 R, 231 B, 232, 235, 237, 90 R; 415/115, 116, 173.1, 173.2

[56] References Cited

U.S. PATENT DOCUMENTS

| | | | |
|---|---|---|---|
| 3,778,183 | 12/1973 | Luscher et al. | 416/115 |
| 3,899,267 | 8/1975 | Dennis et al. | 416/92 |
| 4,142,824 | 3/1979 | Andersen . | |
| 4,424,001 | 1/1984 | North et al. . | |
| 4,893,987 | 1/1990 | Lee et al. . | |
| 5,122,033 | 6/1992 | Paul | 416/96 R |
| 5,261,789 | 11/1993 | Butts et al. . | |
| 5,348,446 | 9/1994 | Lee et al. | 416/241 R |
| 5,370,499 | 12/1994 | Lee . | |
| 5,403,158 | 4/1995 | Auxier | 416/97 R |
| 5,476,363 | 12/1995 | Freling et al. | 415/173.1 |
| 5,476,364 | 12/1995 | Kildea | 416/95 |
| 5,564,902 | 10/1996 | Tomita | 416/97 R |
| 5,660,523 | 8/1997 | Lee | 416/97 R |

OTHER PUBLICATIONS

J. Mayer et al, "Tapered Tip–Rib Turbine Blade," US patent application Ser. No., filed concurrently herewith (Docket 13DV–12871).

Patent Application Serial No. 09/323,375, filed Jun. 1, 1999, entitled "Turbine Blade Tip with Offset Squealer," filed by General Electric Company.

*Primary Examiner*—Edward K. Look
*Assistant Examiner*—Matthew T. Shanley
*Attorney, Agent, or Firm*—Andrew C. Hess; Rodney M. Young

[57] ABSTRACT

A turbine blade includes a hollow airfoil extending from an integral dovetail. The airfoil includes sidewalls extending between leading and trailing edges and longitudinally between a root and a tip. The sidewalls are spaced apart to define a flow channel for channeling cooling air through the airfoil. The tip is tapered longitudinally above at least one of the sidewalls and decreases in thickness.

20 Claims, 3 Drawing Sheets

TAPERED TIP TURBINE BLADE

BACKGROUND OF THE INVENTION

The present invention relates generally to gas turbine engines, and, more specifically, to turbine blade cooling.

In a gas turbine engine, air is pressurized in a compressor and mixed with fuel in a combustor to generate hot combustion gases which flow downstream through one or more turbines which extract energy therefrom. A turbine includes a row of circumferentially spaced apart rotor blades extending radially outwardly from a supporting rotor disk. Each blade typically includes a dovetail which permits assembly and disassembly of the blade in a corresponding dovetail slot in the rotor disk. An airfoil extends radially outwardly from the dovetail.

The airfoil has a generally concave pressure side and generally convex suction side extending axially between corresponding leading and trailing edges and radially between a root and a tip. The blade tip is spaced closely to a radially outer turbine shroud for minimizing leakage therebetween of the combustion gases flowing downstream between the turbine blades. Maximum efficiency of the engine is obtained by minimizing the tip clearance or gap, but is limited by the differential thermal expansion and contraction between the rotor blades and the turbine shroud for reducing the likelihood of undesirable tip rubs.

Since the turbine blades are bathed in hot combustion gases, they require effective cooling for ensuring a useful life thereof. The blade airfoils are hollow and disposed in flow communication with the compressor for receiving a portion of pressurized air bled therefrom for use in cooling the airfoils. Airfoil cooling is quite sophisticated and may be effected using various forms of internal cooling channels and features, and cooperating cooling holes through the walls of the airfoil for discharging the cooling air.

The airfoil tip is particularly difficult to cool since it is located directly adjacent to the turbine shroud, and the hot combustion gases flow through the tip gap therebetween. A portion of the air channeled inside the airfoil is typically discharged through the tip for cooling thereof. The tip typically includes a radially outwardly projecting edge rib disposed coextensively along the pressure and suction sides between the leading and trailing edges. A tip floor extends between the ribs and encloses the top of the airfoil for containing the cooling air therein.

The tip rib is typically the same thickness as the underlying airfoil sidewalls and provides sacrificial material for withstanding occasional tip rubs with the shroud without damaging the remainder of the tip or plugging the tip holes for ensuring continuity of tip cooling over the life of the blade. The tip ribs, also referred to as squealer tips, are typically solid and provide a relatively large surface area which is heated by the hot combustion gases. Since they extend above the tip floor they experience limited cooling from the air being channeled inside the airfoil. Typically, the tip rib has a large surface area subject to heating from the combustion gases, and a relatively small area for cooling thereof. The blade tip therefore operates at a relatively high temperature and thermal stress, and is typically the life limiting point of the entire airfoil.

Accordingly, it is desired to provide a gas turbine engine turbine blade having improved tip cooling.

BRIEF SUMMARY OF THE INVENTION

A turbine blade includes a hollow airfoil extending from an integral dovetail. The airfoil includes sidewalls extending between leading and trailing edges and longitudinally between a root and a tip. The sidewalls are spaced apart to define a flow channel for channeling cooling air through the airfoil. The tip is tapered longitudinally above at least one of the sidewalls and decreases in thickness.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
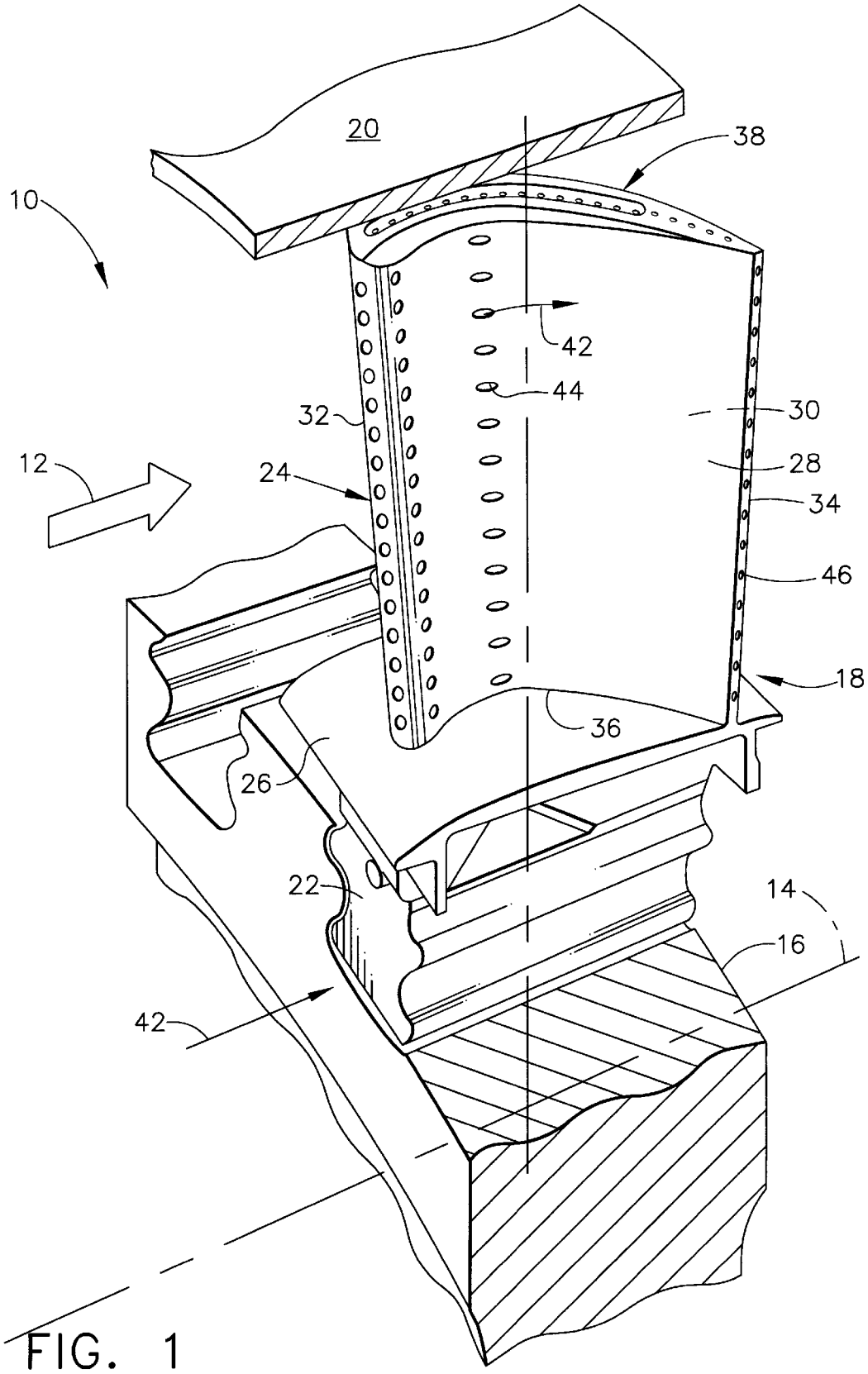
FIG. 1 is a partly sectional, isometric view of an exemplary gas turbine engine turbine rotor blade mounted in a rotor disk within a surrounding shroud, with the blade having a tip in accordance with an exemplary embodiment of the present invention.

Illustrated in FIG. 1 is a portion of a high pressure turbine 10 of a gas turbine engine which is mounted directly downstream from a combustor (not shown) for receiving hot combustion gases 12 therefrom. The turbine is axisymmetrical about an axial centerline axis 14 and includes a rotor disk 16 from which extend radially outwardly a plurality of circumferentially spaced apart turbine rotor blades 18. An annular turbine shroud 20 is suitably joined to a stationary stator casing and surrounds the blades for providing a relatively small clearance or gap therebetween for limiting leakage of the combustion gases therethrough during operation.

Each blade 18 includes a dovetail 22 which may have any conventional form such as an axial dovetail configured for being mounted in a corresponding dovetail slot in the perimeter of the rotor disk 16. A hollow airfoil 24 is integrally joined to the dovetail and extends radially or longitudinally outwardly therefrom. The blade also includes an integral platform 26 disposed at the junction of the airfoil and dovetail for defining a portion of the radially inner flowpath for the combustion gases 12. The blade may be formed in any conventional manner, and is typically a one-piece casting.

The airfoil 24 includes a generally concave, first or pressure sidewall 28 and a circumferentially or laterally opposite, generally convex, second or suction sidewall 30 extending axially or chordally between opposite leading and trailing edges 32,34. The two sidewalls also extend in the radial or longitudinal direction between a radially inner root 36 at the platform 26 and a radially outer tip 38.

Figure 2:
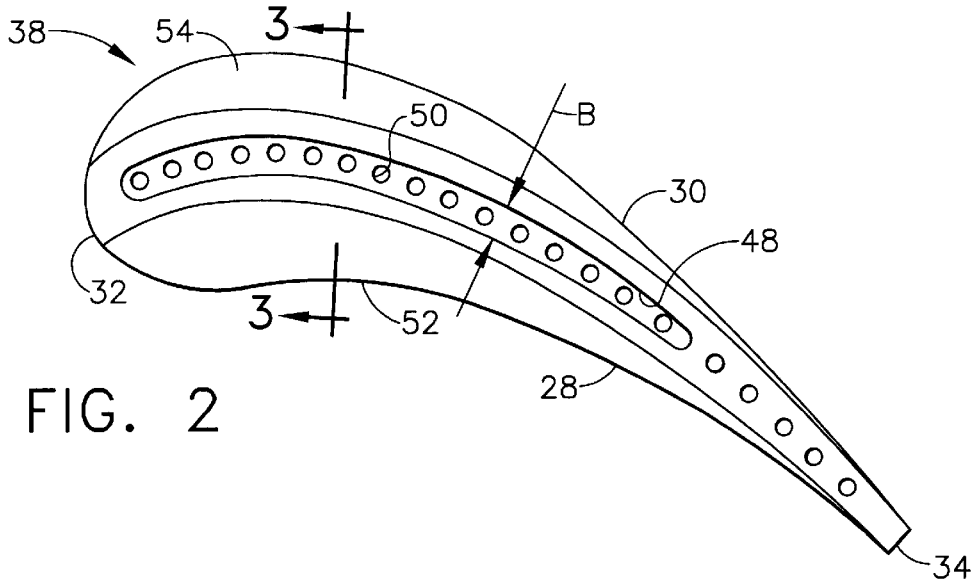
FIG. 2 is a top view of the blade tip illustrated in FIG. 1 and taken along line 2—2.
Figure 3:
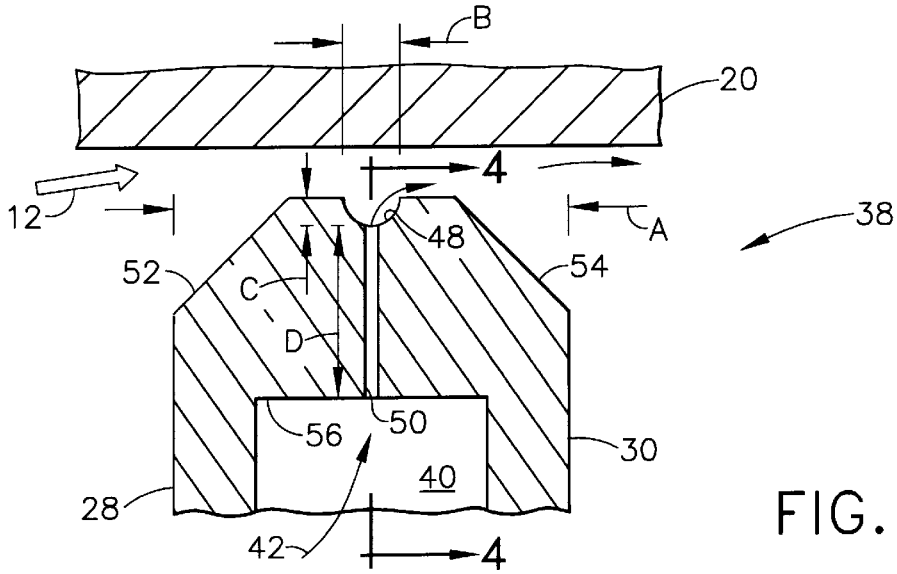
FIG. 3 is an elevational sectional view through the blade tip illustrated in FIG. 2 and taken along line 3—3, and disposed radially within the turbine shroud.

The tip 38 is illustrated in top view in FIG. 2 and in sectional view in FIG. 3, and has a configuration for improving cooling thereof in accordance with an exemplary embodiment of the present invention. As initially shown in FIG. 3, the airfoil first and second sidewalls are spaced apart in the lateral or circumferential direction over the entire longitudinal or radial span of the airfoil to define at least one internal flow channel 40 for channeling cooling air 42 through the airfoil for cooling thereof. The inside of the airfoil may have any conventional configuration including, for example, serpentine flow channels with various turbulators therein for enhancing cooling air effectiveness, with the cooling air being discharged through various holes through the airfoil such as conventional film cooling holes 44 and trailing edge discharge holes 46 as illustrated in FIG. 1.

As shown in FIGS. 2 and 3, the blade tip 38 is preferentially tapered longitudinally in the radial direction above at least one of the two sidewalls 28,30 and decreases in lateral thickness A in accordance with the present invention. The tip taper is specifically configured for reducing the surface area thereof subject to heating from the hot combustion gases 12, while increasing the available area thereof for being cooled by the internal cooling air 42.

As shown in FIG. 3, the tip 38 includes a top recess or slot 48 which is open or faces radially outwardly in a general U-shaped lateral profile, and extends chordally between the leading and trailing edges 32,34 as shown in FIG. 2. A plurality of tip holes 50 extend longitudinally from the internal flow channel 40 to the slot 48 in flow communication therebetween for discharging a portion of the cooling air radially outwardly through the tip holes 50 and into the tip slot 48, from which the air is discharged into the gap between the tip and the shroud. Since the tip 38 is subject to occasional tip rubs with the shroud 20, the tip slot 48 protects the outlet ends of the tip holes 50 from being closed during rubbing for maintaining effective tip cooling during operation.

The blade tip 38 includes a first slope 52 in the form of an inclined and exposed surface which extends chordally between the leading and trailing edges 32,34 as illustrated in FIG. 2, and longitudinally or radially between the first sidewall 28 and tip slot 48 as illustrated in FIG. 3. The first slope 52 therefore effects longitudinal taper of the blade tip.

The blade tip may be laterally symmetrical or non-symmetrical while effecting its taper as required for maximizing cooling effectiveness thereof and aerodynamic performance, to complement the different flow fields along the pressure and suction sides of the airfoil. In the preferred embodiment illustrated in FIG. 3, the blade tip is laterally symmetrical about a radial axis, and further includes a second slope 54 in the form of another inclined surface extending chordally between the leading and trailing edges, and longitudinally between the second sidewall 30 and the tip slot 48. The first and second slopes 52,54 collectively effect the longitudinal taper of the blade tip by decreasing the lateral thickness A in the radially outer direction.

The blade tip also includes a tip floor 56 which is its lower or inner surface extending between the first and second sidewalls 28,30 and between the leading and trailing edges to enclose the flow channel 40 at its radially outer end. The first and second slopes 52,54 converge toward the tip slot 48 directly atop the tip floor 56 for both reducing heat surface area and increasing conduction cooling of the blade tip. The tip holes 50 extend radially inwardly through the floor 56 and provide internal convection cooling therein.

The converging profile of the blade tip illustrated in FIG. 3 eliminates the pressure and suction side corners which would otherwise be found in a conventional blade tip. In this way, the inclined slopes have a substantially reduced area exposed to the hot combustion gases 12 which correspondingly reduces the heat influx thereto. Correspondingly, the blade tip is solid above the tip floor 56 and is more effectively cooled by the cooling air 42 circulating within the flow channel 40 and discharged through the tip holes 50.

The tip slot 48 illustrated in FIG. 3 is preferably laterally centered between the first and second sidewalls 28,30 for both minimizing the external surface area of the slopes subject to heating while maximizing the internal heat conduction by the cooling air in the flow channel and tip holes.

Figure 5:
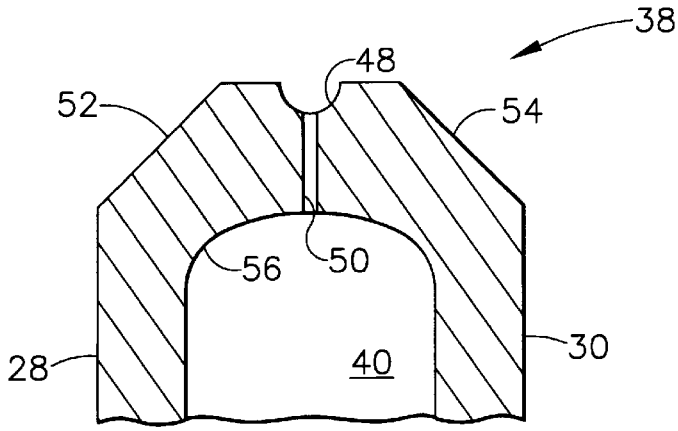
FIG. 5 is an elevational sectional view like FIG. 3 illustrating the blade tip in accordance with another embodiment of the present invention.

In the exemplary embodiment illustrated in FIG. 3, the tip floor 56 is straight and substantially perpendicular between the two sidewalls 28,30. FIG. 5 illustrates an alternate embodiment of the blade tip wherein the tip floor 56 is laterally arcuate or concave atop the flow channel 40 for decreasing the thickness of the blade tip 38 between the respective slopes 52,54 and the tip floor 56. This decreases the thermal mass of the blade tip as well as provides a shorter heat conduction flowpath to the available cooling air.

As shown in FIGS. 2 and 3, the tip slot 48 preferably has a substantially constant lateral width B chordally between its opposite ends near the leading and trailing edges. The tip slot also has a longitudinal or radial depth C which is preferably significantly smaller than a corresponding depth D of the tip holes 50. The lateral profile of the tip slot may be straight-sided, or arcuate as illustrated.

In this way, the slot 48 is shallow and provides a common plenum fed by the multiple tip holes 50 from which the cooling air 42 may be discharged into the tip gap. The resulting small volume of the tip slot 48 decreases the likelihood of recirculation therein of the combustion gases 12 flowing across the tip slot during operation.

Figure 4:
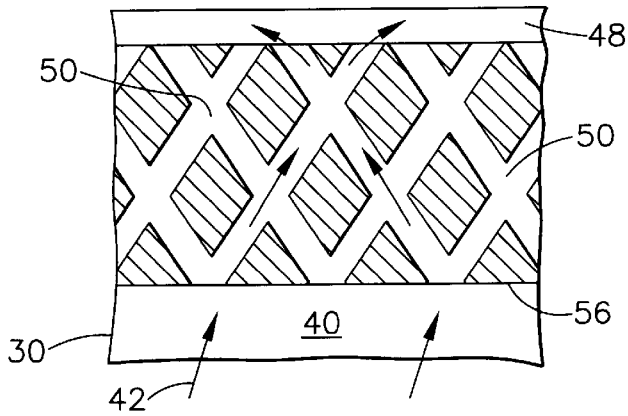
FIG. 4 is an elevational sectional view through the blade tip illustrated in FIG. 3 and taken along line 4—4.

The tip holes 50 illustrated in FIG. 3 may extend radially through the blade tip or may be inclined therethrough. For example, FIG. 4 illustrates a preferred embodiment of the present invention wherein the tip holes 50 intersect each other obliquely inside the blade tip to define a mesh of multiply intersecting holes. Since the tip slot 48 is shallow and the tip holes 50 extend substantially the entire height of the blade tip, the blade tip provides suitable area for effecting the mesh cooling by the intersecting holes.

In the exemplary embodiment illustrated in FIGS. 2 and 3, the blade tip 38 is substantially flat around the tip slot 48 adjoining the first and second slopes 52,54 between the leading and trailing edges. This provides a flat rubbing land at the radially outermost portion of the blade tip with correspondingly small squealer tip ribs on opposite sides of the tip slot 48. In this way, the benefits of conventional squealer tips may also be enjoyed in the tapered blade tip including effecting a form of labyrinth seal between the blade tip and the turbine shroud 20. Furthermore, tip rubs with the shroud are confined to the exposed squealer tips, and reduce damage to the blade tip and protect the recessed tip holes 50 from being closed during the rub.

As shown in FIG. 2, the tip slot 48 extends chordally from closely adjacent the leading edge 32 for substantially the entire axial extent of the airfoil subject to the available space at the narrow trailing edge 34.

In the exemplary embodiments of the blade tip illustrated in FIGS. 3 and 5 for example, the first and second slopes 52,54 are longitudinally or radially straight from the respective sidewalls 28,30 as they converge toward the center tip slot 48.

Figure 6:
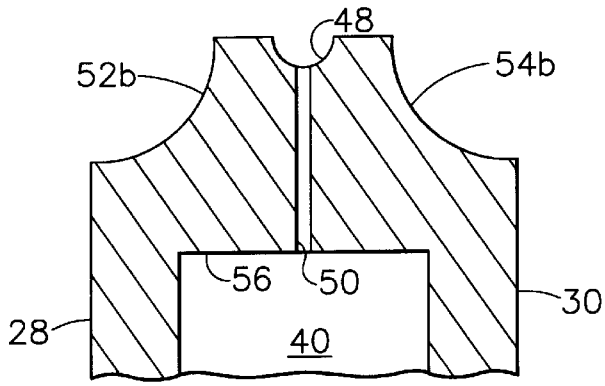
FIG. 6 is an elevational sectional view like FIG. 3 illustrating the blade tip in accordance with another embodiment of the present invention.

In another embodiment of the blade tip illustrated in FIG. 6, the first and second slopes, designated 52*b*,54*b*, are longitudinally arcuate in the radial direction, and for example are concave. This configuration not only decreases the exposed surface area of the two slopes subject to combustion gas heating, but decreases the conduction path to the tip holes 50 and tip floor 56 for enhanced cooling effectiveness.

Figure 7:
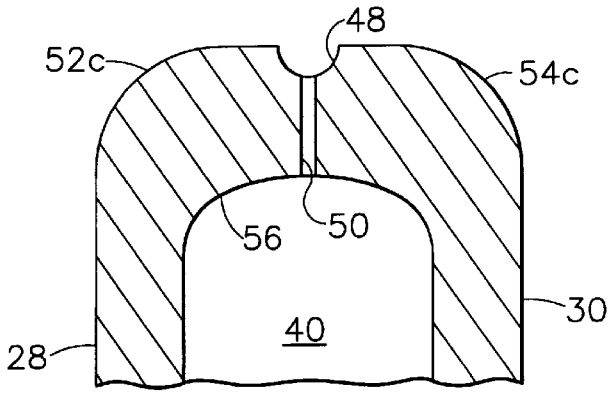
FIG. 7 is an elevational sectional view like FIG. 3 illustrating the blade tip in accordance with another embodiment of the present invention.

FIG. 7 illustrates yet another embodiment of the invention wherein the first and second slopes, designated 52*c*,54*c*, are longitudinally convex. And, the tip floor 56 is correspondingly convex, again for decreasing the exposed external surface area of the slopes and decreasing the conduction cooling path to the tip holes 50 and tip floor 56.

The several embodiments of the blade tip disclosed above effectively reduce the external heating surface area of the blade tip, while correspondingly increasing the cooling effectiveness thereof. The major portion of the blade tip is directly above the tip floor 56 which is relatively cold during operation for enhancing conduction cooling of the entire blade tip. The tip slot 48 is preferably centered between the opposite sidewalls of the airfoil and provides an effective two-tooth squealer tip for sealing the tip gap while accommodating occasional tip rubs. And, if desired, additional tip holes may be provided between the flow channel and one or both of the two slopes for providing additional cooling, such as film cooling thereof.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. A gas turbine engine blade comprising:

a dovetail;

an airfoil integrally joined to said dovetail, and including first and second sidewalls extending between leading and trailing edges and longitudinally between a root and a solid tip, and said sidewalls being spaced laterally apart to define with said tip a flow channel for channeling cooling air through said airfoil; and said tip includes a slot extending between said leading and trailing edges and facing outwardly atop said flow channel, and said tip is externally tapered laterally inwardly from at least one of said sidewalls to diverge therefrom, and decreases in lateral thickness longitudinally thereabove to decrease thickness of said tip to said flow channel.

2. A blade according to claim 1 wherein said tip further includes:

a plurality of tip holes extending longitudinally from said flow channel to said slot in flow communication therebetween.

3. A blade according to claim 2 wherein said tip further includes a laterally outwardly facing first slope extending chordally between said leading and trailing edges, and longitudinally between said first sidewall and tip slot to effect said taper.

4. A blade according to claim 3 wherein said first slope is longitudinally straight.

5. A gas turbine engine blade comprising:

a dovetail;

an airfoil integrally joined to said dovetail, and including first and second sidewalls extending between leading and trailing edges and longitudinally between a root and tip and said sidewalls increased laterally apart to define a flow channel for channeling cooling air through said airfoil; and said tip includes:

a slots extending between said leading and trailing edges and facing outwardly;

a plurality of tip holes extending longitudinally from said flow channel to said slot in flow communication therebetween;

a laterally outwardly facing first slope extending chordally between said leading and trailing edges, and being longitudinally arcuate between said first sidewall and tip slop to effect a longitudinal taper decreasing in lateral thickness above said first sidewell.

6. A blade according to claim 5 wherein said first slope is longitudinally concave.

7. A blade according to claim 5 wherein said first slope is longitudinally convex.

8. A blade according to claim 3 wherein said tip holes intersect each other obliquely inside said tip to define a mesh of multiply intersecting holes.

9. A gas turbine engine blade comprising;

a dovetail;

an airfoil integrally joined to said dovetail, and including first and second sidewalls extending between leading and trailing edges and longitudinally between a root and a solid tip, and said sidewalls being spaced laterally apart to define with said tip a flow channel for channel cooling air through said airfoil; and said tip includes:

a slot extending between said leading and trailing edges and facing outwardly;

a plurality of tip holes extending longitudinally form said flow channel to said slot in flow communication therebetween;

a laterally outwardly facing first slope extending chordally between said leading and trailing edges, and longitudinally between said first sidewall and tip slot; and a laterally outwardly facing second slope extending chordally between said leading and trailing edges, and longitudinally between said second sidewall and tip slot to collectively affect with said first slope taper of said tip for decreasing lateral thickness thereof longitudinally above said first and second sidewalls to decrease thickness of said tip to said flow channel.

10. A blade according to claim 9 wherein:

said tip further includes a tip floor extending between said first and second sidewalls and leading and trailing edges to enclose said flow channel; and said first and second slopes converge toward said tip slot atop said tip floor.

11. A blade according to claim 10 wherein said tip floor is laterally arcuate atop said flow channel for decreasing thickness of said tip.

12. A blade according to claim 10 wherein said tip slot is substantially centered between said first and second sidewalls.

13. A blade according to claim 10 wherein said tip slot has a substantially constant width.

14. A blade according to claim 10 wherein said tip slot and tip holes have longitudinal depths, with said slot depth being smaller than said hole depth.

15. A blade according to claim 10 wherein said tip is substantially flat around said tip slot adjoining said first and second slopes between said leading and trailing edges.

16. A blade according to claim 10 wherein said first and second slopes are longitudinally straight.

17. A blade according to claim 10 wherein said first and second slopes are longitudinally arcuate.

18. A blade according to claim 17 wherein said first and second slopes are longitudinally concave.

19. A blade according to claim 17 wherein said first and second slopes are longitudinally convex.

20. A blade according to claim 10 wherein said first and second slopes are symmetrical.

* * * * *